US009452865B2

(12) United States Patent
Joshi et al.

(10) Patent No.: US 9,452,865 B2
(45) Date of Patent: Sep. 27, 2016

(54) ADJUSTABLE SHELF RACK HAVING A MODULAR SHELVING SYSTEM

(71) Applicant: Honda Motor Co., Ltd., Minato-ku, Tokyo (JP)

(72) Inventors: Aneet Joshi, Barrie (CA); Jobanjit Singh, Barrie (CA); Tharmilan Selvathurai, Toronto (CA)

(73) Assignee: Honda Motor Co., Ltd., Tokyo (JP)

( * ) Notice: Subject to any disclaimer, the term of this patent is extended or adjusted under 35 U.S.C. 154(b) by 31 days.

(21) Appl. No.: 14/319,565

(22) Filed: Jun. 30, 2014

(65) Prior Publication Data

US 2015/0374119 A1 Dec. 31, 2015

(51) Int. Cl.
*B65D 19/06* (2006.01)

(52) U.S. Cl.
CPC ..... *B65D 19/06* (2013.01); *B65D 2519/0097* (2013.01); *B65D 2519/00273* (2013.01); *B65D 2519/00298* (2013.01); *B65D 2519/00353* (2013.01); *B65D 2519/00532* (2013.01);
(Continued)

(58) Field of Classification Search
CPC ..... A47B 45/00; A47B 5/00; A47B 5/04; A47B 57/04; A47B 57/045; A47B 57/30; A47B 96/025; B62B 2205/30; B62B 2205/32; B62B 2205/33; B62B 3/002; B62B 3/005; B62B 3/08; B62B 3/10; B62B 3/102; B62B 3/104; B65D 19/385; B65D 19/40; B65D 19/44
USPC ..... 211/41.14, 41.15, 41.16, 150, 169, 211/169.1
See application file for complete search history.

(56) References Cited

U.S. PATENT DOCUMENTS 1,312,861 A 8/1919 Morris
1,322,173 A * 11/1919 Baker ..... A47B 57/04 108/1
1,856,935 A * 5/1932 Turner ..... B65G 1/0442 108/91

(Continued)

FOREIGN PATENT DOCUMENTS

DE 10349656 A1 * 6/2005 ..... B65D 19/08

OTHER PUBLICATIONS

Creform Corp., "Drawbridge Shelf Cart uses gas struts," news.thonnasnet.com; http://news.thomasnet.com/fullstory/Drawbridge-Shelf-Cart-uses gas-struts-20007794 (Accessed Jul. 3, 2014); May 3, 2013; pp. 1-2.

(Continued)

*Primary Examiner* — Joshua Rodden
(74) *Attorney, Agent, or Firm* — Arent Fox LLP

(57) ABSTRACT

A shelf for a modular shelving system includes a frame having a rectangular configuration. A front shelf member has a first end portion and an opposite second end portion. A rear shelf member is positioned parallel with the front shelf member and has a first end portion and an opposite second end portion. A first side shelf member is coupled to and extends between the front shelf member first end portion and the rear shelf member first end portion. A second side shelf member is coupled to and extends between the front shelf member second end portion and the rear shelf member second end portion. A cross-member extends between and is removably coupled to the first side shelf member and the second side shelf member. One or more support assemblies are removably coupled to the cross-member and reconfigurable to facilitate supporting a plurality of different dunnage.

13 Claims, 13 Drawing Sheets

(52) U.S. Cl.
CPC ..... *B65D2519/00796* (2013.01); *B65D 2519/00815* (2013.01)

(56) References Cited

U.S. PATENT DOCUMENTS

| | | | | |
|---|---|---|---|---|
| 2,877,602 | A | 3/1959 | Larsen | |
| 3,120,199 | A * | 2/1964 | Kolster | A47B 57/04 108/6 |
| 3,199,464 | A | 8/1965 | Shook | |
| 3,508,665 | A * | 4/1970 | Sobel | A47B 57/045 211/150 |
| 3,527,360 | A * | 9/1970 | Thielking | A47F 5/0037 211/126.5 |
| 3,533,502 | A * | 10/1970 | Hansen | A47B 45/00 206/386 |
| 3,857,494 | A | 12/1974 | Giardini | |
| 3,863,799 | A | 2/1975 | Thomaswick et al. | |
| 3,981,511 | A * | 9/1976 | Foster | B62B 5/049 211/150 |
| 4,159,831 | A * | 7/1979 | Schorr | B62B 3/004 211/49.1 |
| 4,428,304 | A | 1/1984 | Moser | |
| 5,145,073 | A | 9/1992 | Kitagawa et al. | |
| 5,154,310 | A | 10/1992 | Massey | |
| 5,242,255 | A | 9/1993 | Gleffe et al. | |
| 5,244,104 | A * | 9/1993 | Green | F26B 25/18 211/150 |
| 5,257,896 | A | 11/1993 | Hastings | |
| 5,324,105 | A * | 6/1994 | Christensen | A47F 7/0057 206/303 |
| 5,810,186 | A | 9/1998 | Lam | |
| 5,979,338 | A | 11/1999 | Salmanson et al. | |
| 6,123,208 | A | 9/2000 | Haenszel | |
| 6,146,068 | A | 11/2000 | Schroeder | |
| 6,220,462 | B1 * | 4/2001 | Brockman | A47B 46/005 108/902 |
| 6,244,194 | B1 | 6/2001 | Salmanson et al. | |
| 6,279,763 | B1 | 8/2001 | Bush | |
| 6,360,904 | B1 * | 3/2002 | Schilb | B23Q 7/10 211/187 |
| 6,415,934 | B1 * | 7/2002 | Veltrop | A47J 37/1295 211/85.4 |
| 6,422,405 | B1 | 7/2002 | Haenszel | |
| 6,505,900 | B2 | 1/2003 | Frederick | |
| 6,588,608 | B2 | 7/2003 | Pater | |
| 6,609,466 | B2 | 8/2003 | Salmanson et al. | |
| 6,705,476 | B2 | 3/2004 | Linder et al. | |
| 6,722,292 | B2 | 4/2004 | Salmanson et al. | |
| 6,925,943 | B2 | 8/2005 | Salmanson et al. | |
| 6,935,818 | B2 | 8/2005 | Hoeper et al. | |
| 7,159,521 | B2 | 1/2007 | Salmanson et al. | |
| 7,401,709 | B2 | 7/2008 | Stingel, Jr. et al. | |
| 7,621,487 | B2 | 11/2009 | Brown et al. | |
| 7,918,165 | B2 | 4/2011 | Owen | |
| 8,127,948 | B2 | 3/2012 | Davis et al. | |
| 8,210,374 | B2 | 7/2012 | Harpole | |
| 8,261,921 | B2 | 9/2012 | Anscomb et al. | |
| 8,297,452 | B2 | 10/2012 | Anscomb et al. | |
| 8,434,631 | B2 | 5/2013 | Harpole | |
| 8,556,093 | B2 | 10/2013 | Davis et al. | |
| 8,616,388 | B2 | 12/2013 | Butler | |
| 2006/0016774 | A1 | 1/2006 | Bustos | |
| 2007/0092350 | A1 | 4/2007 | Schorer | |

OTHER PUBLICATIONS

Topper Industrial, "Cart transports 3,000 lb of dunnaged parts," news.thomasnet.com; http://news.thomasnet.com/fullstory/Cart-transports-3-000-lb-of-dunnaged-parts-21189 (Accessed Jul. 3, 2014); Apr. 9, 2003; p. 1.

"Rack Dunnage," www.ipakusa.com; http://www.ipakusa.com/images/rackdunnage/GrosslinkRackDunnage5.jpg (Accessed Jul. 3, 2014); 1 page.

* cited by examiner

ADJUSTABLE SHELF RACK HAVING A MODULAR SHELVING SYSTEM

BACKGROUND

The subject matter disclosed herein relates to an adjustable shelf rack and, more particularly, to an adjustable shelf rack including a rack frame and a modular shelving system removably coupled to the rack frame.

At least some conventional shelf racks include shelves coupled to a frame of the shelf rack. Each shelf includes a plurality supports for supporting dunnage, such as a component, part, or product. These supports are not easily modified or reconfigured to accommodate different types of dunnage. For example, if an existing shelf must be reconfigured to support a different type of dunnage, the supports of these conventional shelf racks must be sheered or broken off the shelf frame and a new support coupled to the shelf frame in order to configure the shelf for supporting the new dunnage.

An adjustable shelf rack including a rack frame and a modular shelving system removably coupled to the rack frame is desirable.

SUMMARY

In one aspect, an adjustable shelf rack includes a rack frame including a first vertical support channel coupled to a first side member of the rack frame and a second vertical support channel coupled to a second side member of the rack frame opposing the first side member. A modular shelving system includes at least one shelf pivotally coupled to and extending between the first vertical support channel and the second vertical support channel. The at least one shelf includes a frame having a plurality of shelf members. A transverse cross-member is removably coupled to the frame. Each of a plurality of support assemblies is removably coupled to the transverse cross-member. Each support assembly is reconfigurable to facilitate supporting a plurality of different components.

In another aspect, a shelf for a modular shelving system includes a plurality of perforated shelf members coupled together to form an outer frame having a rectangular configuration. The plurality of perforated shelf members include a front shelf member having a first end portion and an opposite second end portion. A rear shelf member is positioned parallel with the front shelf member and has a first end portion and an opposite second end portion. A first side shelf member is coupled to and extends between the front shelf member first end portion and the rear shelf member first end portion. A second side shelf member is coupled to and extends between the front shelf member second end portion and the rear shelf member second end portion. A cross-member extends between and is removably coupled to the first side shelf member and the second side shelf member. Each of a plurality of support assemblies is removably coupled to the transverse cross-member. Each support assembly is reconfigurable to facilitate supporting a plurality of different components.

In yet another aspect, a method for reconfiguring a shelf of a modular shelving system to support different dunnage is provided. The shelf includes a plurality of perforated shelf members coupled together to form a frame having a rectangular configuration. The method includes removably coupling a transverse cross-member to each of a first side shelf member of the plurality of perforated shelf members and an opposing second side shelf member of the plurality of perforated shelf members at a location with respect to a front shelf member of the plurality of perforated shelf members coupled between the first side shelf member and the second side shelf member; and removably coupling a plurality of support assemblies to the transverse cross-member, each support assembly of the plurality of support assemblies reconfigurable to facilitate supporting a plurality of different dunnage.

BRIEF DESCRIPTION OF THE DRAWINGS

Other aspects and advantages of certain embodiments will become apparent upon consideration of the following detailed description, wherein similar structures have similar reference numerals.

DETAILED DESCRIPTION

The embodiments described herein overcome difficulties associated with conventional shelf racks by providing an adjustable shelf rack including a rack frame and a modular shelving system removably coupled to the rack frame. In one embodiment, the rack frame includes vertical support channels coupled to each of a first side member of the rack frame and a second side member of the rack frame opposing the first side member. The vertical support channels define a plurality of linear spaced openings for pivotally coupling one or more shelves of the modular shelving system to the rack frame. Each shelf includes a plurality of support assemblies removably coupled to one or more transverse cross-members and/or to one or more shelf members forming the shelf frame for supporting a corresponding component, part, or product. Further, each support assembly includes one or more supports that can be removed from the shelf and reconfigurable to facilitate supporting a plurality of different components, parts, and/or products. Also described herein is a method for reconfiguring a shelf of the modular shelving system to accommodate a different component, part or product for service and/or shipping.

Figure 6:
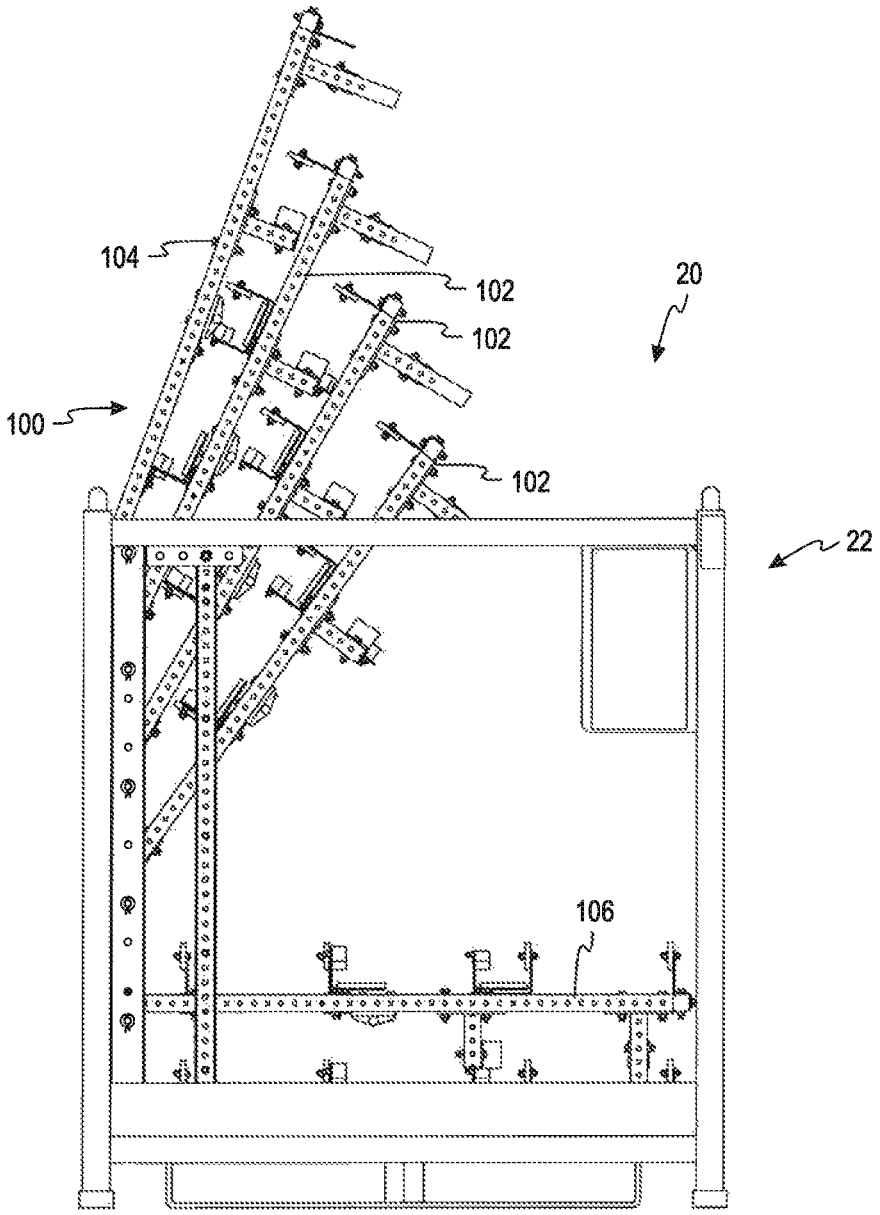
FIG. 6 is a side view of the adjustable shelf rack shown in FIG. 1 in an open position.
Figure 7:
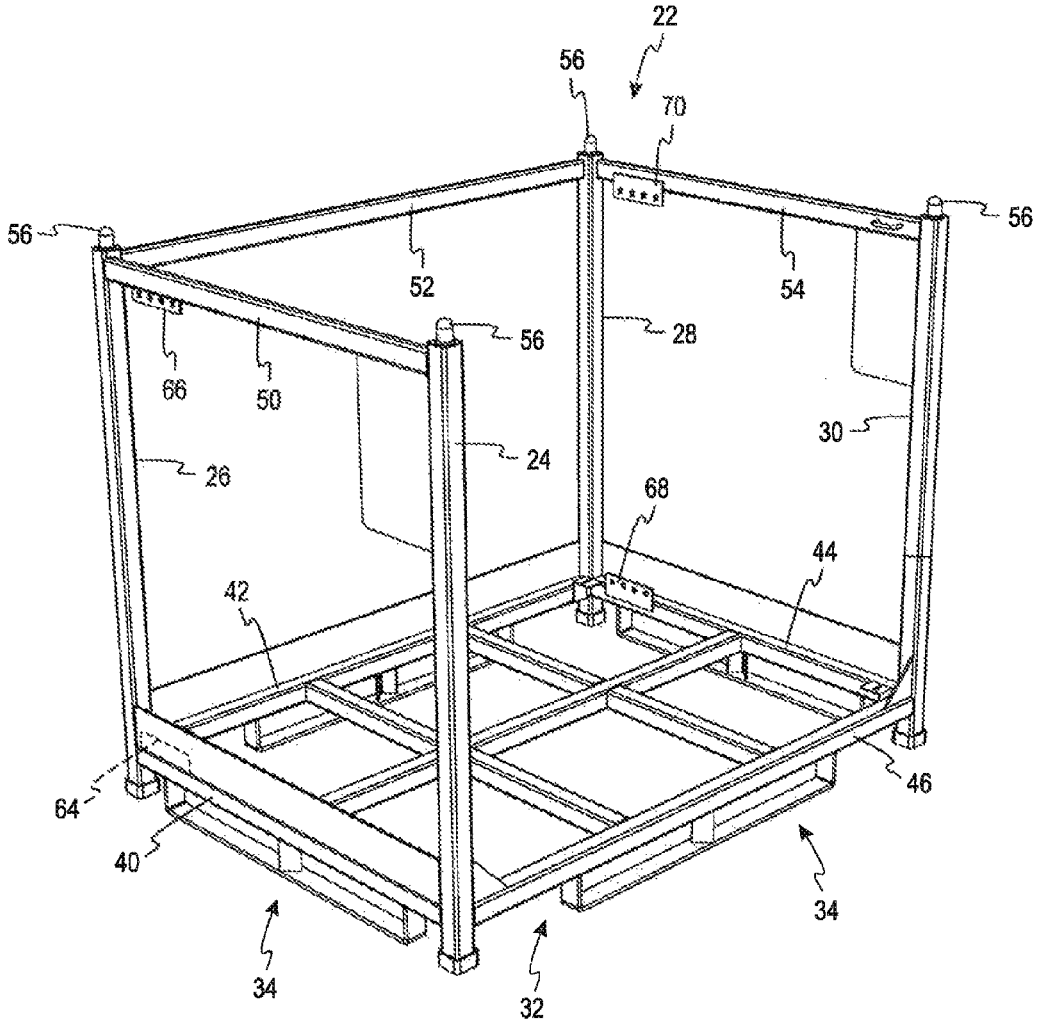
FIG. 7 is a perspective view of an exemplary rack frame for the adjustable shelf rack shown in FIG. 1 according to one embodiment.

Referring now to FIGS. 1-12 and, initially to FIGS. 1-3 and 7, an adjustable shelf rack 20 includes a rack frame 22 having a plurality of vertical frame posts, such as four frame posts 24, 26, 28, 30. As shown in FIGS. 1-3 and 7, for example, rack frame 22 includes a base 32 coupled to a bottom portion of rack frame 22. Base 32 includes one or more guides 34 configured to receive a fork lift blade, for example, to facilitate moving adjustable shelf rack 20 with a fork lift or another suitable machine. Referring further to FIG. 7, base 32 is formed with a first lower frame member 40 coupled between frame posts 24, 26; a second lower frame member 42 coupled between frame posts 26, 28; a third lower frame member 44 coupled between frame posts 28, 30; and a fourth lower frame member 46 is coupled between frame posts 24, 30. At an opposing end of each frame post, a first upper frame member 50 is coupled between frame posts 24, 26; a second upper frame member 52 is coupled between frame posts 26, 28; and a third upper frame member 54 is coupled between frame posts 28, 30. In one embodiment, each frame post 24, 26, 28, 30 includes a suitably shaped projection, such as a stacking cap 56, to facilitate stacking an additional rack frame (not shown) on rack frame 22. In a particular embodiment, stacking cap 56 is formed on or coupled to respective frame post 24, 26, 28, 30.

Figure 3:
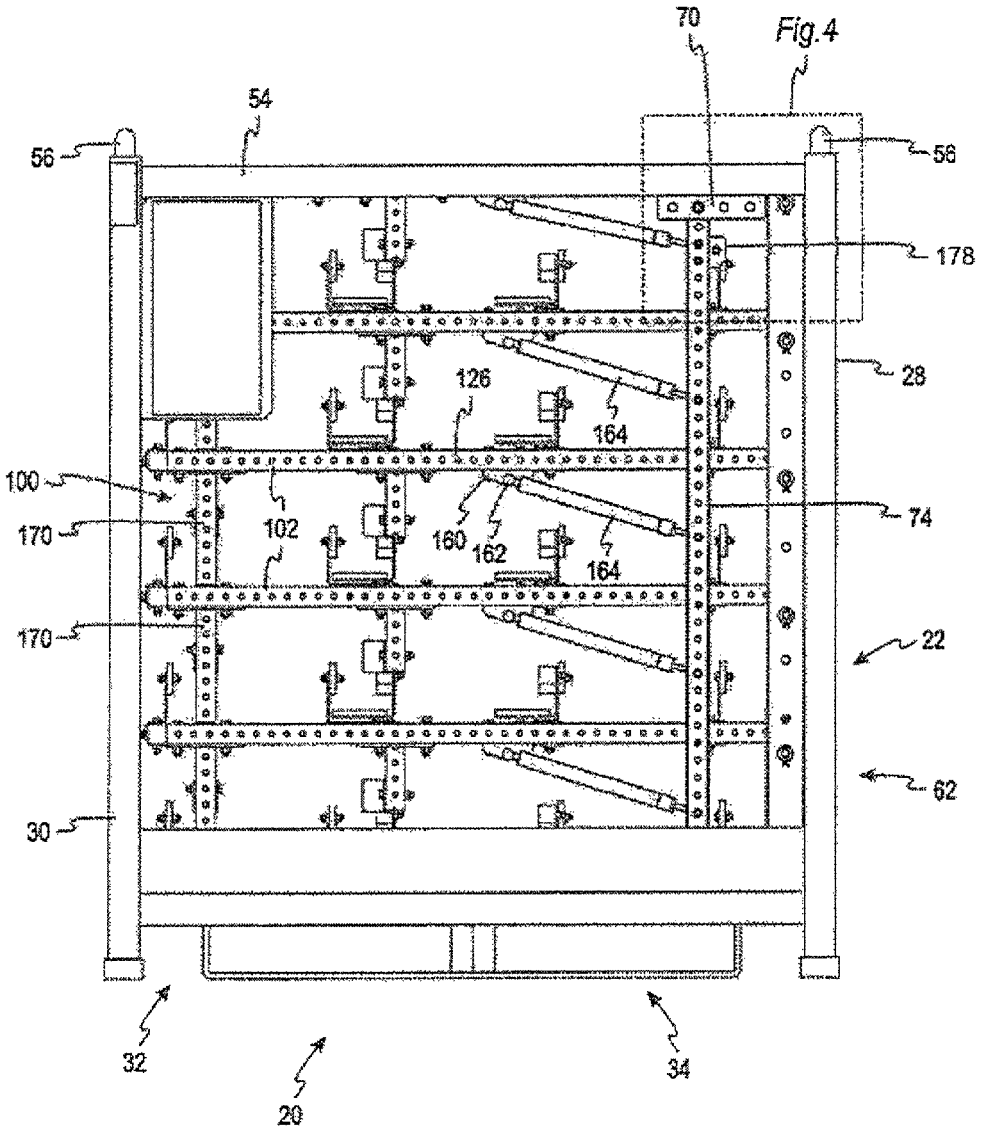
FIG. 3 is a side view of the adjustable shelf rack shown in FIG. 1.
Figure 4:
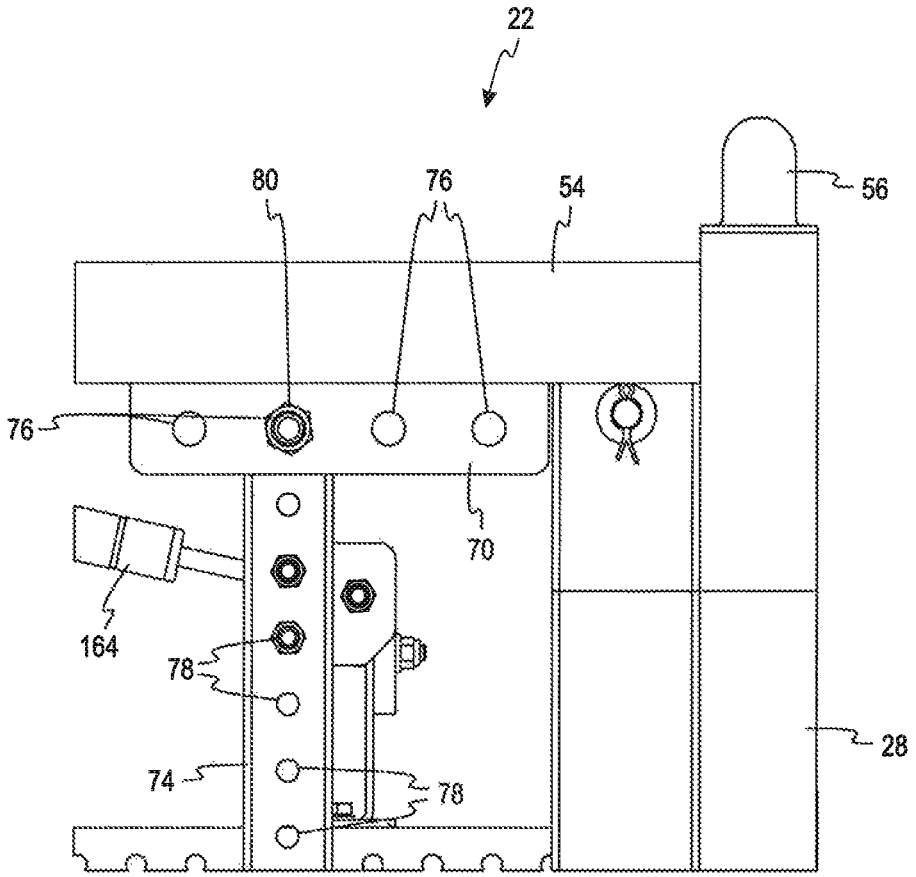
FIG. 4 is a partial view of the adjustable shelf rack shown in FIG. 3.
Figure 5:
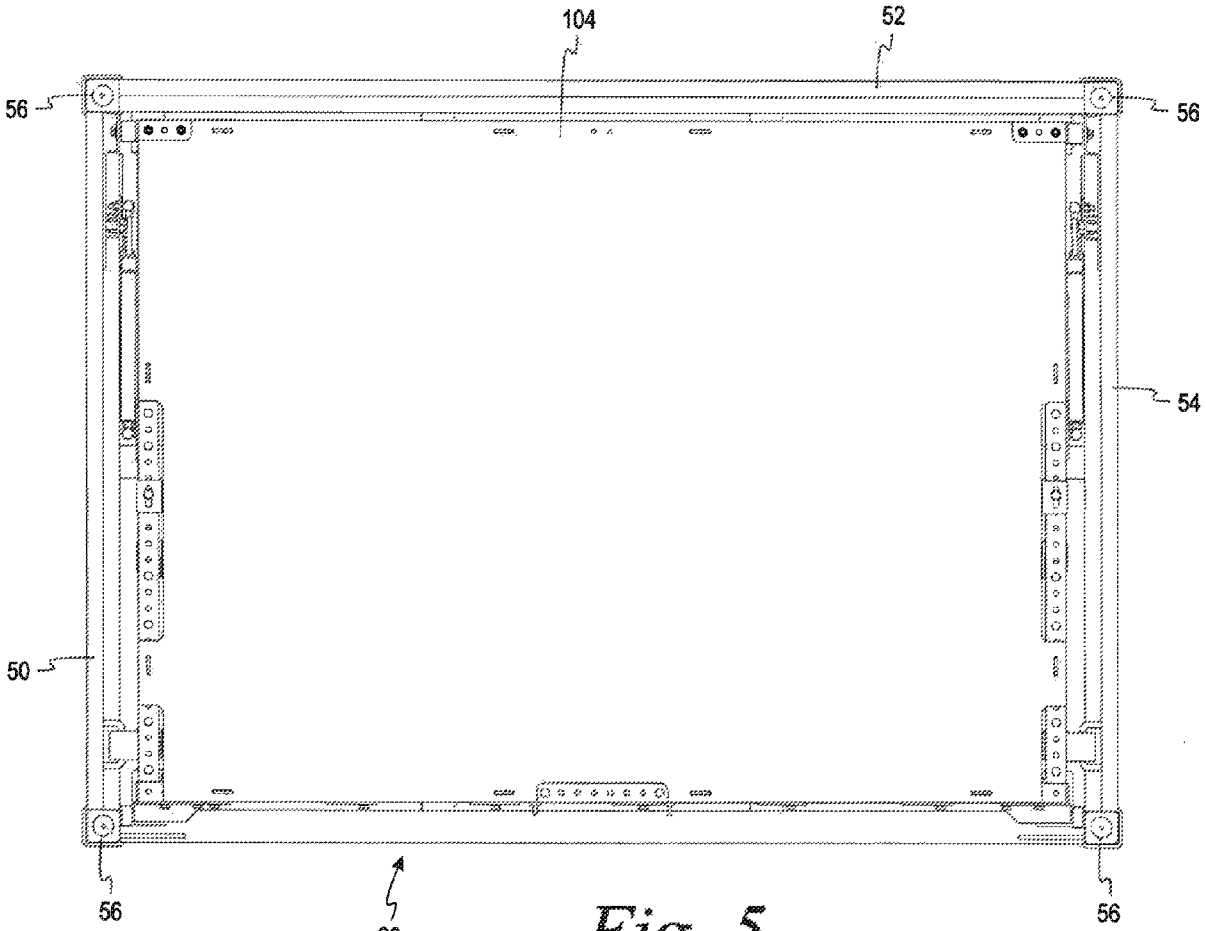
FIG. 5 is a top view of the adjustable shelf rack shown in FIG. 1.

Referring now to FIGS. 3, 4, and 7, for example, vertical support channels are coupled to each of a first side member 60 and an opposing second side member 62 of rack frame 22. More specifically, in one embodiment as shown in FIG. 7, a first lower channel mounting plate 64 is coupled to first lower frame member 40 and a first upper channel mounting plate 66 is coupled to first upper frame member 50. Similarly, a second lower channel mounting plate 68 is coupled to third lower frame member 44 and a second upper channel mounting plate 70 is coupled to third upper frame member 54. A first vertical support channel 72, shown in FIG. 1, for example, is coupled to first side member 60 between first lower channel mounting plate 64 and first upper channel mounting plate 66 and an opposing second vertical support channel 74, shown in FIG. 3, for example, is coupled to second side member 62 between second lower channel mounting plate 68 and second upper channel mounting plate 70.

Referring now to FIG. 4, each of first lower channel mounting plate 64, first upper channel mounting plate 66, second lower channel mounting plate 68, and second upper channel mounting plate 70 defines a plurality of linearly spaced openings 76 for coupling respective first vertical support channel 72 or second vertical support channel 74 to rack frame 22. Each of first vertical support channel 72 and second vertical support channel 74 defines a plurality of linearly spaced openings 78. In the embodiment shown in FIG. 4, an opening 78 defined in an upper end of second vertical support channel 74 is aligned with the second opening 76 defined in second upper channel mounting plate 70 and an opening 78 defined in a lower end of second vertical support channel 74 is aligned with the corresponding second opening on second lower channel mounting plate 68. Suitable fasteners 80, such as a hex bolt and associated lock nut, removably couple second vertical support channel 74 to second side member 62 of rack frame 22.

Referring again to FIGS. 1-3 and 8-11, adjustable shelf rack 20 includes a modular shelving system 100 removably coupled to rack frame 22. Modular shelving system 100 includes at least one shelf pivotally coupled to and extending between first vertical support channel 72 and second vertical support channel 74. In the embodiment shown, modular shelving system 100 includes at least one middle shelf 102, as shown in FIG. 8, for example, removably and pivotally coupled to and extending between first vertical support channel 72 and second vertical support channel 74, an upper shelf 104, as shown in FIG. 10, for example, removably and pivotally coupled to and extending between first vertical support channel 72 and second vertical support channel 74, and a lower shelf 106, as shown in FIG. 12, for example, removably coupled to rack frame 22.

Figure 8:
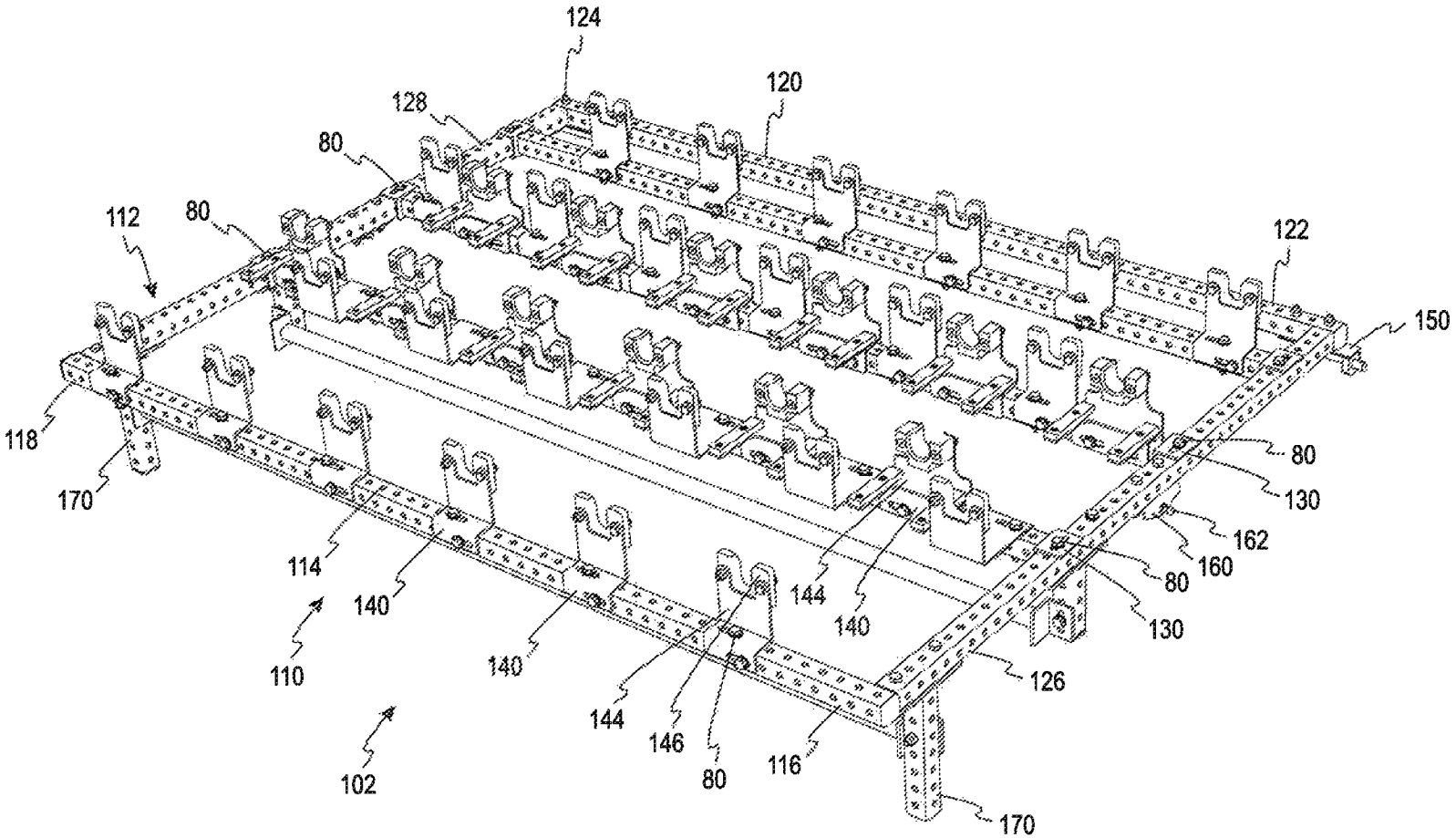
FIG. 8 is a perspective view of an exemplary shelf for the adjustable shelf rack shown in FIG. 1 according to one embodiment.

Referring further to FIG. 8, for example, each middle shelf 102 includes a frame 110 formed of a plurality of perforated shelf members coupled together to form an outer frame 112 having a rectangular configuration. In one embodiment, each shelf member has four panels forming a rectangular cross-section of the shelf member and defining a plurality of linearly spaced openings through each panel forming the perforated shelf member. As shown in FIG. 8, a front shelf member 114 has a first end portion 116 and an opposite second end portion 118. A rear shelf member 120 is positioned parallel with front shelf member 114 and has a first end portion 122 and an opposite second end portion 124. A first side shelf member 126 is coupled to and extends between first end portion 116 of front shelf member 114 and first end portion 122 of rear shelf member 120. A second side shelf member 128 is coupled to and extends between second end portion 118 of first shelf member 114 and second end portion 124 of rear shelf member 120.

As shown in FIG. 8, in one embodiment one or more transverse cross-members 130 are removably coupled to frame 110. Each transverse cross-member 130 extends parallel to front shelf member 114 and rear shelf member 120 between first shelf member 126 and second shelf member 128. In one embodiment, one ore more cross-members 130 are movable with respect to front shelf member 114 and rear shelf member 120 to facilitate supporting different components, parts, and/or products. For example, fasteners 80 removably coupling cross-member 130 to each of first side shelf member 126 and second side shelf member 128 can be removed and cross-member 130 can be moved toward front shelf member 114 or toward rear shelf member 120 to a desired location. At the desired location, cross-member 130 is removably coupled to each of first side shelf member 126 and second side shelf member 128 using fasteners 80. A plurality of support assemblies 140 are removably coupled to at least one cross-member 130. Each support assembly 140 is reconfigurable to facilitate supporting a plurality of different components, parts, and/or products. As shown in FIG. 8, each support assembly 140 includes one or more supports 142 for supporting a corresponding component, part, or product. In one embodiment, support 142 includes a mounting bracket 144 and a pad 146 coupled to mounting bracket 144. Pad 146 is formed of a suitable material, such as high density polyethylene (HDPE), to help secure the corresponding component within support assembly 140 and protect the corresponding component from damage during service and/or transport, for example.

In one embodiment, each support 142 is removably coupled to a cross-member 130, front shelf member 114, or rear shelf member 120 using suitable fasteners 80, such as a hex bolt and associated lock nut. Because each support 142 of support assembly 140 is removably coupled to cross-member 130, front shelf member 114, or rear shelf member 120, middle shelf 102 is suitable for use to support different components, parts, and/or products. For example, middle shelf 102 may include a plurality of support assemblies 140 initially configured to support steering columns for a vehicle model. Supports 142 of each support assembly 140 are configured and/or aligned to support a corresponding steering column at desired locations along a length of the steering column. Support assemblies 140 can be reconfigured to support a different component, part, or product, such as a drive shaft for a vehicle model. In order to reconfigure support assembly 140 to support a corresponding drive shaft, one or more supports 142 of support assembly 140 are removed from an initial location on middle shelf 102 and removably coupled to a different location on middle shelf 102, for example, to cross-member 130, front shelf member 114, or rear shelf member 120. With supports 142 reconfigured and properly aligned, support assembly 140 is reconfigured to support the drive shaft.

Figure 9:
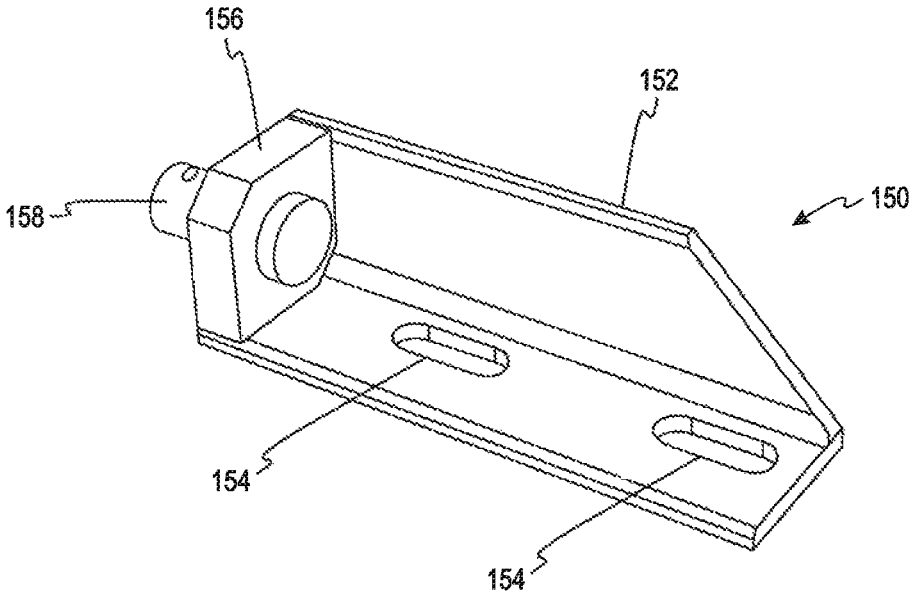
FIG. 9 is a perspective view of a hinge bracket support assembly suitable for use with the shelf shown in FIG. 8.
Figure 10:
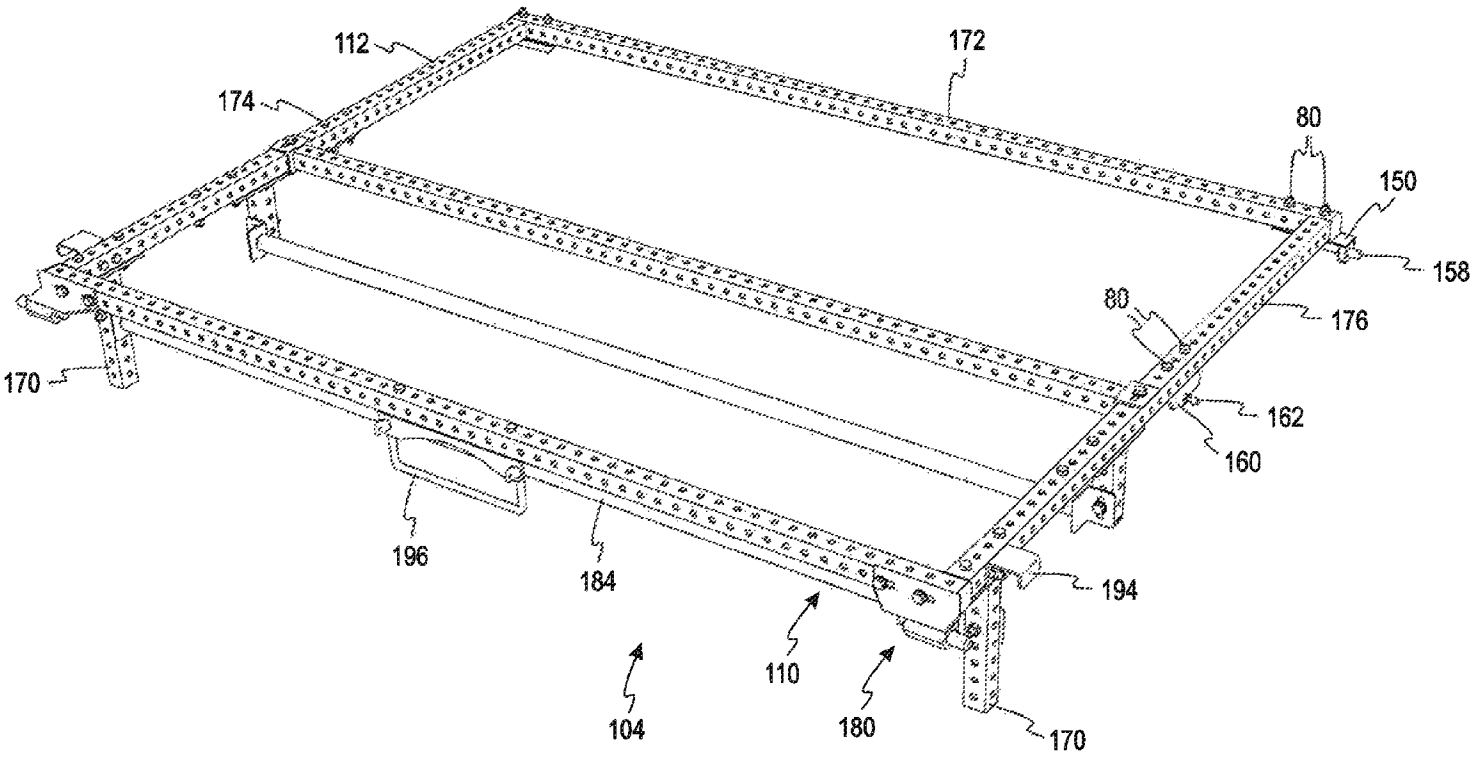
FIG. 10 is a perspective view of an exemplary upper shelf for the adjustable shelf rack shown in FIG. 1 according to one embodiment.

Referring to FIGS. 8 and 9, in one embodiment middle shelf 102 includes a hinge bracket assembly 150 pivotally coupled to first vertical support channel 72 and an additional hinge bracket assembly 150 pivotally coupled to second vertical support channel 74. Hinge bracket assembly 150 includes a mounting angle 152 coupled to rear shelf member 120 and/or first side shelf member 126 using one or more suitable fasteners 80, such as a hex bolt and associate lock nut. Mounting angle 152 of additional hinge bracket assembly 150 is coupled to rear shelf member 120 and/or second side shelf member 128. Mounting angle 152 defines a plurality of slotted openings 154 through which one or more fasteners 80 can be positioned to allow adjustment of a width of middle shelf 102 as necessary to pivotally mount middle shelf 102 within aligned openings 78 in first vertical support channel 72 and second vertical support channel 74. A clevis mount 156 is coupled to or integrated with mounting angle 152 and a clevis pin 158 extends laterally outward from clevis mount 156 toward respective first vertical support channel 72 or second vertical support channel 74. Clevis pin 158 extends into and is positioned within respective opening 78 formed in first vertical support channel 72 or second vertical support channel 74.

As shown in FIG. 8, middle shelf 102 also includes a mounting bracket 160 coupled to first side shelf member 126 using one or more suitable fasteners 80, such as a hex bolt and associated lock nut. Mounting bracket 160 has a ball stud 162 extending laterally outward from mounting bracket 160. A suitable spring mechanism 164 is coupled to ball stud 162 and extends between ball stud 162 and first vertical support channel 72. Spring mechanism 164 is configured to facilitate pivotally moving corresponding middle shelf 102 with respect to rack frame 22. Referring further to FIG. 3, for example, an additional mounting bracket 160 having a ball stud 162 is coupled to second side shelf member 128. An additional spring mechanism 164 is coupled to ball stud 162 and extends between ball stud 162 and second vertical support channel 74 to facilitate pivotally moving corresponding middle shelf 102 with respect to rack frame 22.

Figure 1:
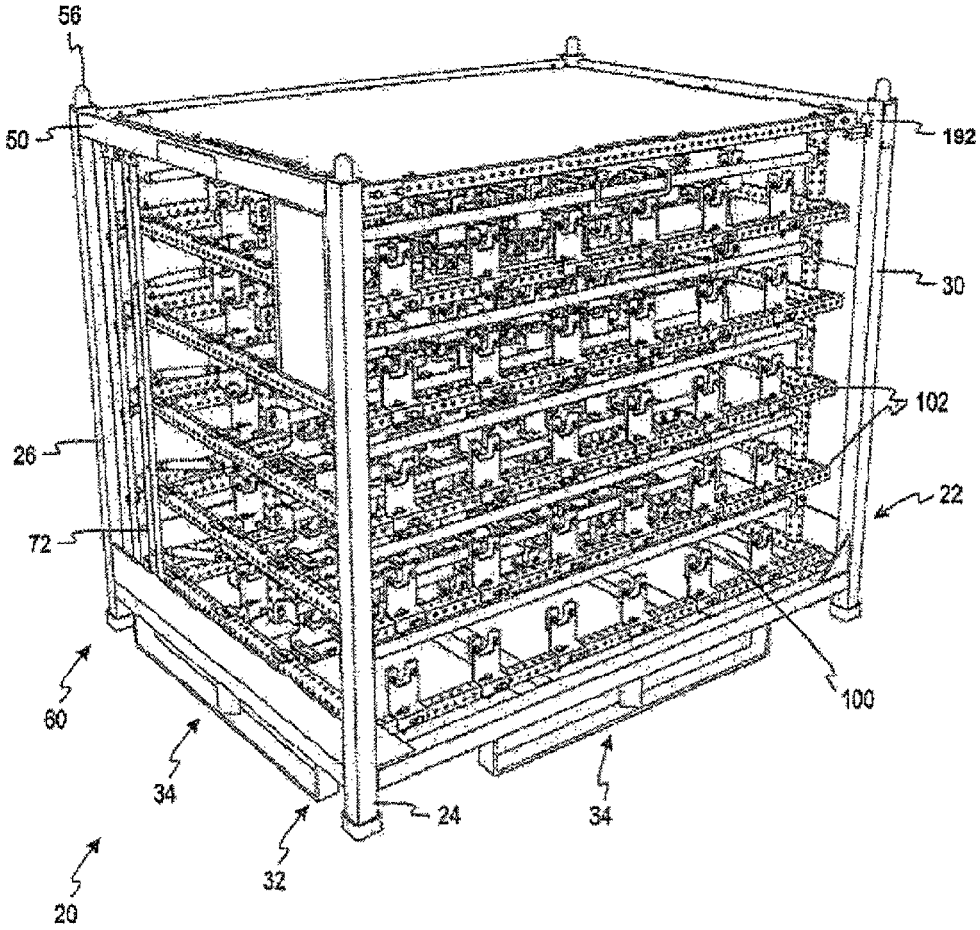
FIG. 1 is a perspective view of an exemplary adjustable shelf rack in a closed position with a modular shelving system for supporting dunnage.
Figure 2:
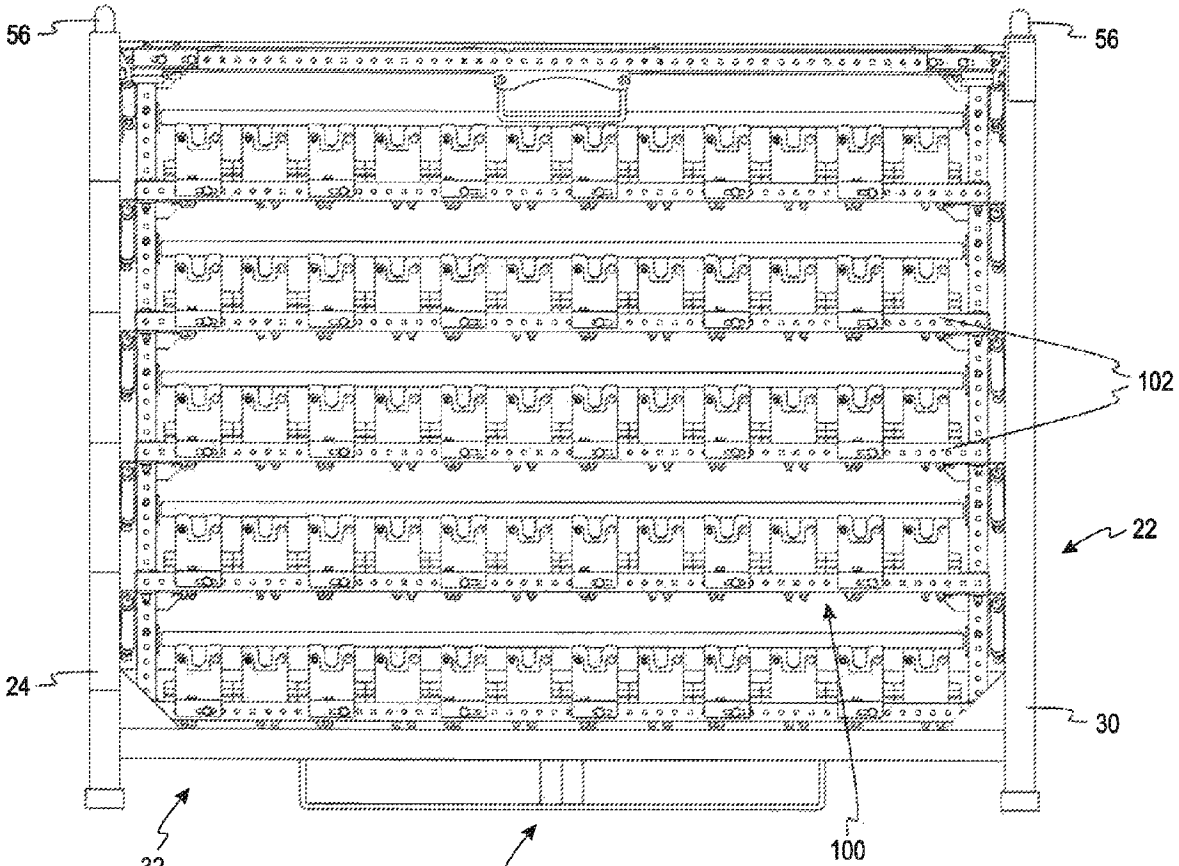
FIG. 2 is a front view of the adjustable shelf rack shown in FIG. 1.

In one embodiment, one or more legs 170 are coupled to middle shelf 102 to facilitate maintaining a suitable space from an adjacent shelf. For example, in a particular embodiment one leg 170 is coupled to first side shelf member 126 proximate to first end portion 116 of front shelf member 114 and one leg 170 is coupled to second side shelf member 128 proximate to second end portion 118 of front shelf member 114. Each leg 170 contacts frame 110 of an adjacent shelf with modular shelving system 100 in the closed position, as shown in FIGS. 1-3, for example, to maintain spacing with the adjacent shelf.

Referring now to FIG. 10, in one embodiment modular shelving system 100 includes an upper shelf 104 pivotally coupled to and extending between first vertical support channel 72 and second vertical support channel 74. Upper shelf 104 includes frame 110 formed of a plurality of perforated shelf members coupled together to form outer frame 112 having a rectangular configuration. In one embodiment, each shelf member has four panels forming a rectangular cross-section of the shelf member and defining a plurality of linearly spaced openings through each panel forming the perforated shelf member. Similar to middle shelf 102, upper shelf 104 includes a hinge bracket assembly 150 pivotally coupled to first vertical support channel 72 and an additional hinge bracket assembly 150 pivotally coupled to second vertical support channel 74. Hinge bracket assembly 150 includes a mounting angle 152 coupled to a rear shelf member 172 and/or a first side shelf member 174 using one or more suitable fasteners 80, such as a hex bolt and associate lock nut. Mounting angle 152 of additional hinge bracket assembly 150 is coupled to rear shelf member 172 and/or a second side shelf member 176 opposing first side shelf member 174. A respective clevis pin 158 extends into and is positioned within a respective opening 78 formed in first vertical support channel 72 or second vertical support channel 74 to pivotally couple upper shelf 104 to rack frame 22.

Upper shelf 104 also includes a mounting bracket 160 coupled to first side shelf member 174 using one or more suitable fasteners 80, such as a hex bolt and associated lock nut. Mounting bracket 160 has ball stud 162 extending laterally outward from mounting bracket 160. Referring further to FIGS. 1, 3, and 6, for example, spring mechanism 164 is coupled to ball stud 162 and extends between ball stud 162 and first vertical support channel 72. In a particular embodiment, a ball stud plate 178 is removably coupled to first vertical support channel 72 using one or more suitable fasteners 80, such as a hex bolt and associated lock nut, and spring mechanism 164 is coupled between ball stud 162 and ball stud plate 178. Spring mechanism 164 is configured to facilitate pivotally moving upper shelf 104 with respect to rack frame 22. An additional mounting bracket 160 having ball stud 162 is coupled to second side shelf member 176. An additional spring mechanism 164 is coupled to ball stud 162 and extends between ball stud 162 and second vertical support channel 74 to facilitate pivotally moving upper shelf 104 with respect to rack frame 22. In one embodiment, upper shelf 104 is operatively coupled to each middle shelf 102 such that as upper shelf 104 moves between the open position, as shown in FIG. 6, and the closed position, as shown in FIGS. 1-5, upper shelf 104 cooperatively urges each middle shelf 104 to correspondingly move between the open position and the closed position.

Figure 11:
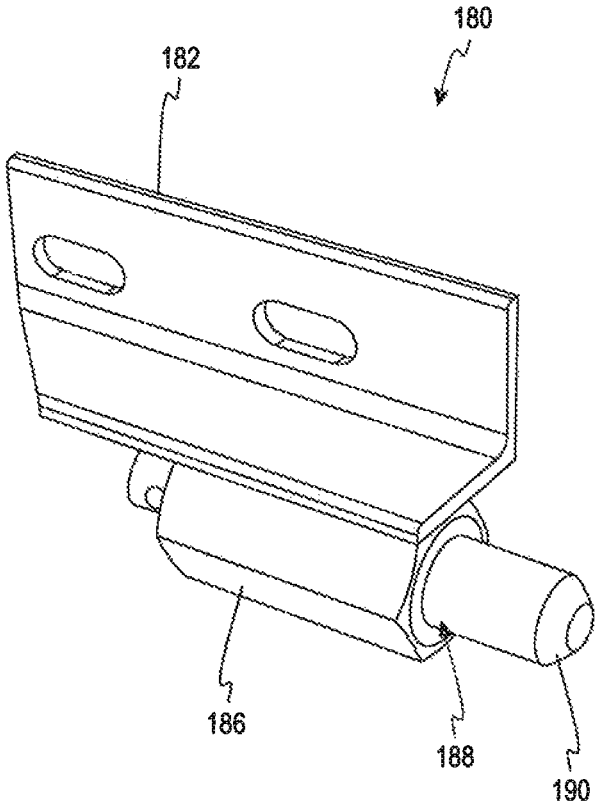
FIG. 11 is a perspective view of a latch assembly suitable for use with the upper shelf shown in FIG. 10.
Figure 12:
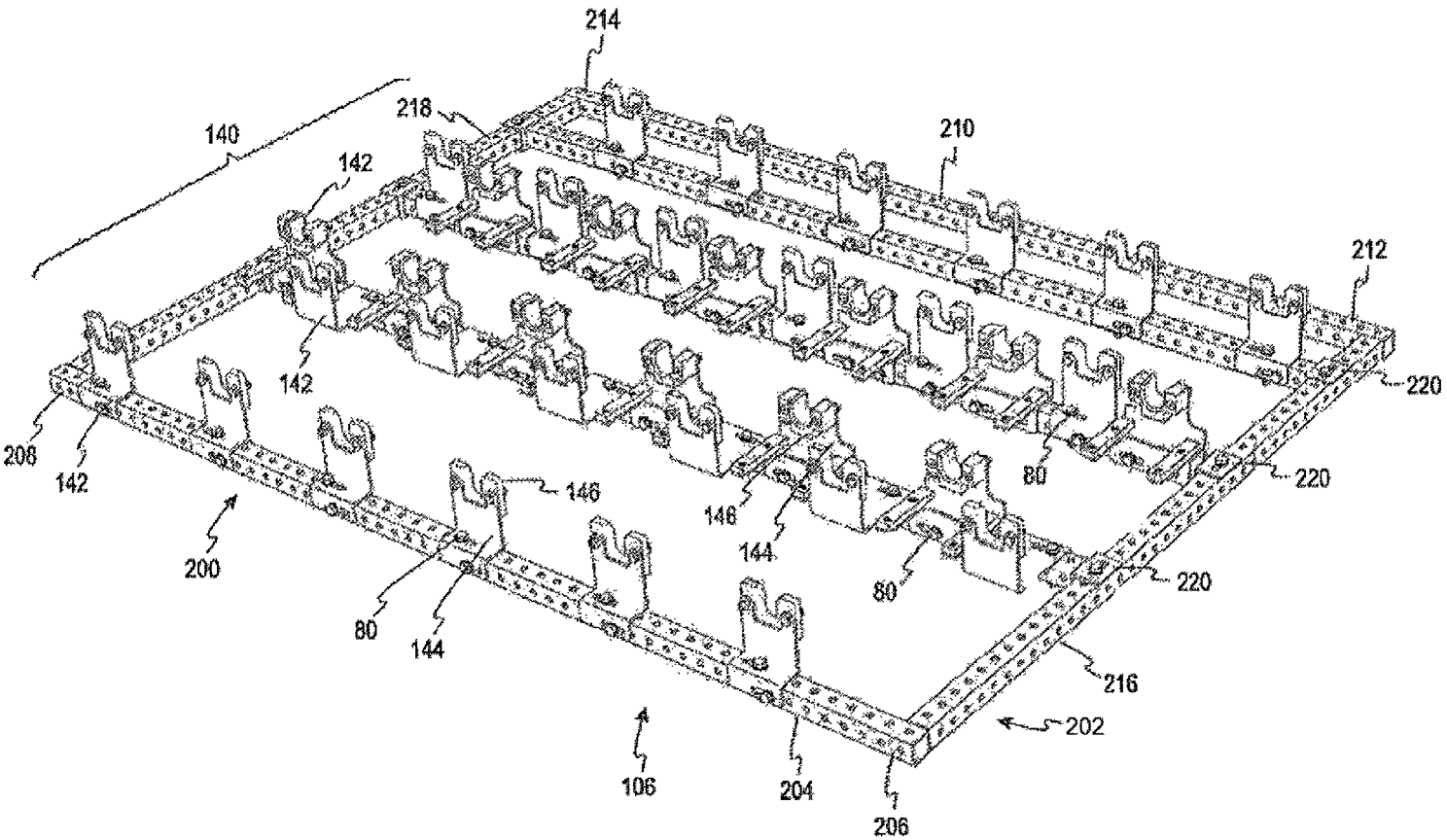
FIG. 12 is a perspective view of an exemplary lower shelf for the adjustable shelf rack shown in FIG. 1 according to one embodiment.

Referring to FIGS. 10 and 11, a latch assembly 180 is coupled to upper shelf 104. Latch assembly 180 includes a mounting angle 182 coupled to a front shelf member 184 of upper shelf 104. A suitable housing 186 is coupled to mounting angle 182 and defines a passage 188. A pin 190 is slidably positioned with passage 188. In one embodiment, pin 190 is slidably movable within passage 188 between a retracted position, with pin 190 positioned within passage 188 and an extended position, as shown in FIG. 11. In the extended position, pin 190 extends into an opening 192, as shown in FIG. 7, defined in first side member 30 of rack frame 22 to lock upper shelf 104 in the closed position. In a particular embodiment, a catch plate 194 is removably coupled to upper shelf 104 to facilitate maintaining upper shelf 104 in the closed position and a suitable handle 196 is coupled to upper shelf 104 to facilitate moving upper shelf 104 between the closed position, as shown in FIGS. 1-3, and the open position, as shown in FIG. 6.

In one embodiment, one or more legs 170 are coupled to upper shelf 104 to facilitate maintaining a suitable space from an adjacent middle shelf 102. For example, in a particular embodiment one leg 170 is coupled to first side shelf member 174 proximate to first front shelf member 184 and one leg 170 is coupled to second side shelf member 176 proximate to front shelf member 184. Each leg 170 contacts frame 110 of an adjacent middle shelf 102 with modular shelving system 100 in the closed position, as shown in FIGS. 1-3, for example, to maintain spacing with the adjacent middle shelf 102.

Referring now to FIG. 12, in one embodiment modular shelving system 100 includes a lower shelf 106 removably coupled to rack frame 22. Lower shelf 106 includes a frame 200 formed of a plurality of perforated shelf members coupled together to form an outer frame 202 having a rectangular configuration. In one embodiment, each shelf member has four panels forming a rectangular cross-section of the shelf member and defining a plurality of linearly spaced openings through each panel forming the perforated shelf member. As shown in FIG. 12, a front shelf member 204 has a first end portion 206 and an opposite second end portion 208. A rear shelf member 210 is positioned parallel with front shelf member 204 and has a first end portion 212 and an opposite second end portion 214. A first side shelf member 216 is coupled to and extends between first end portion 206 of front shelf member 204 and first end portion 212 of rear shelf member 210. A second side shelf member 218 is coupled to and extends between second end portion 208 of front shelf member 204 and second end portion 214 of rear shelf member 210.

As shown in FIG. 12, in one embodiment one or more transverse cross-members 220 are removably coupled to frame 200. Each transverse cross-member 220 extends parallel to front shelf member 204 and rear shelf member 210 between first shelf member 216 and second shelf member 218. A plurality of support assemblies 140, as described above, are removably coupled to at least one cross-member 220. Each support assembly 140 is reconfigurable to facilitate supporting a plurality of different components, parts or products. As shown in FIG. 12, each support assembly 140 includes one or more supports 142 for supporting a corresponding component, part, or product. In one embodiment, support 142 includes a mounting bracket 144 and a pad 146 coupled to mounting bracket 144. In one embodiment, each support 142 is removably coupled to a cross-member 220, front shelf member 204, or rear shelf member 210 using one or more suitable fasteners 80, such as a hex bolt and associated lock nut. Because each support 142 of support assembly 140 is removably coupled to cross-member 220, front shelf member 204, or rear shelf member 210, lower shelf 106 is suitable for use to support different components, parts, and/or products, as described above with reference to middle shelf 102.

Figure 13:
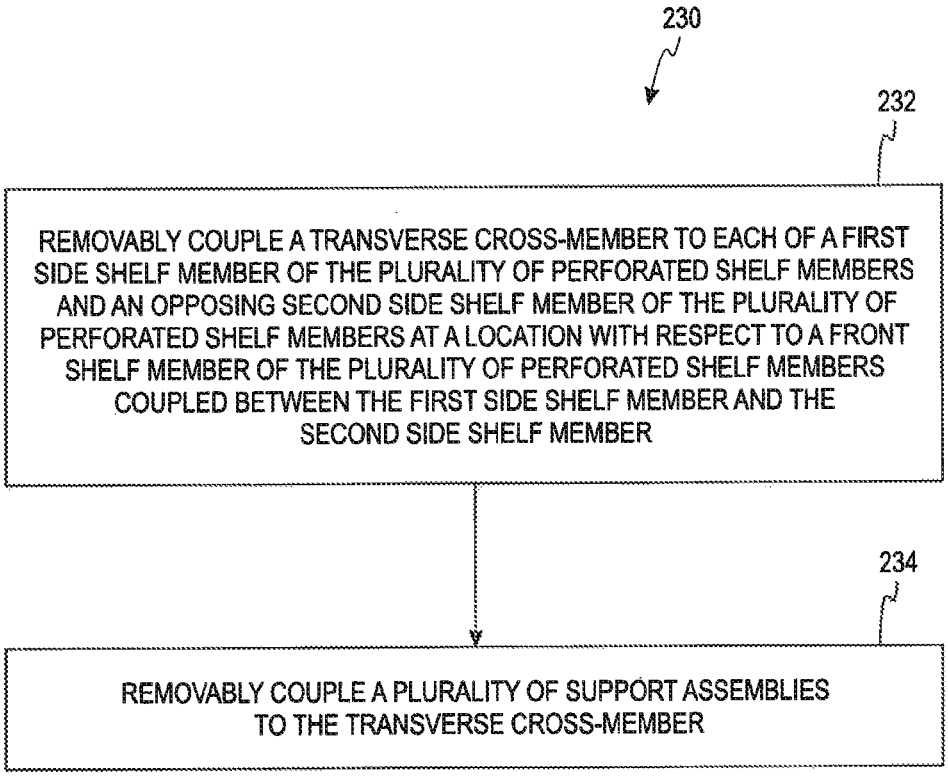
FIG. 13 illustrates an exemplary method for reconfiguring a shelf of a modular shelving system to support different dunnage.

Referring to FIG. 13, an exemplary method 230 for reconfiguring a shelf of a modular shelving system to support different dunnage is provided. The shelf, such as middle shelf 102 or lower shelf 106 described above, includes a plurality of perforated shelf members coupled together to form a frame having a rectangular configuration. A transverse cross-member is removably coupled 232 to each of a first side shelf member of the plurality of perforated shelf members and an opposing second side shelf member of the plurality of perforated shelf members at a location with respect to a front shelf member of the plurality of perforated shelf members coupled between the first side shelf member and the second side shelf member. A plurality of support assemblies are removably coupled 234 to the transverse cross-member. Each support assembly of the plurality of support assemblies is reconfigurable to facilitate supporting a plurality of different dunnage.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended the scope be defined by the claims appended hereto. Additionally, the features of various implementing embodiments may be combined to form further embodiments. As used herein, the word "exemplary" means serving as an example, instance, or illustration. Any aspect or embodiment described herein as "exemplary" is not necessarily to be construed as preferred or advantageous over other aspects or embodiments.

What is claimed is:

1. An adjustable shelf rack, comprising:

a rack frame including a first vertical support channel coupled to a first side member of the rack frame and a second vertical support channel coupled to a second side member of the rack frame opposing the first side member, wherein the rack frame further comprises a channel mounting plate defining a plurality of openings, a fastener positionable within one of the plurality of openings and an aligned opening defined in the first vertical support channel to couple the first vertical support channel to the first side member of the rack frame; and a modular shelving system including at least one shelf pivotally coupled to and extending between the first vertical support channel and the second vertical support channel, the at least one shelf comprising:

a frame including a plurality of shelf members;

a transverse cross-member removably coupled to the frame; and a plurality of support assemblies removably coupled to the transverse cross member, each support assembly of the plurality of support assemblies reconfigurable to facilitate supporting a plurality of different components.

2. The adjustable shelf rack of claim 1, wherein each support assembly comprises at least one support for supporting a corresponding component.

3. The adjustable shelf rack of claim 2, wherein the at least one support is a plurality of supports and wherein a first support of the plurality of supports is removably coupled to the frame and a second support of the plurality of supports is removably coupled to the transverse cross-member, the first support and the second support configured to support the corresponding component.

4. The adjustable shelf rack of claim 2, wherein the at least one support is a plurality of supports and wherein each of a first support and a second support of the plurality of supports comprises a mounting bracket and a pad coupled to the mounting bracket, the pad formed of a material to facilitate protecting the corresponding component from damage.

5. The adjustable shelf rack of claim 1, wherein the plurality of shelf members are coupled together to form the frame having a rectangular configuration, the plurality of shelf members comprising:

a front shelf member having a first end portion and an opposite second end portion;

a rear shelf member positioned parallel with the front shelf member and having a first end portion and an opposite second end portion;

a first side shelf member coupled to and extending between the front shelf member first end portion and the rear shelf member first end portion; and a second side shelf member coupled to and extending between the front shelf member second end portion and the rear shelf member second end portion.

6. The adjustable shelf rack of claim 5, wherein the at least one shelf further comprises a hinge bracket assembly pivotally coupled to the first vertical support channel, the hinge bracket assembly comprising:

a mounting angle coupled to the rear shelf member;

a clevis mount coupled to the mounting angle; and a clevis pin extending laterally outward from the clevis mount, the clevis pin pivotally positionable within one of a plurality of openings defined in the first vertical support channel.

7. The adjustable shelf rack of claim 6, wherein the at least one shelf further comprises:

a mounting bracket coupled to the first side shelf member, the mounting bracket having a ball stud extending outwardly from the mounting bracket; and a spring mechanism coupled between the ball stud and the first vertical support channel, the spring mechanism configured to facilitate pivotally moving the at least one shelf with respect to the rack frame.

8. The adjustable shelf rack of claim 5, further comprising a leg coupled to the first side shelf member proximate to the front shelf member first end portion, the leg contacting a frame of an adjacent shelf of the at least one shelf with the modular shelving system in a closed position to maintain spacing with the adjacent shelf.

9. The adjustable shelf rack of claim 1, wherein the modular shelving system further comprises an upper shelf pivotally coupled to the first vertical support channel, the upper shelf pivotally movable between an open position and a closed position to cooperatively urge the at least one shelf between the open position and the closed position.

10. The adjustable shelf rack of claim 9, wherein the upper shelf further comprises:

a mounting bracket coupled to a first side shelf member of the upper shelf, the mounting bracket having a ball stud extending laterally outward from the mounting bracket;

a ball stud plate removably coupled to the first vertical support channel; and a spring mechanism coupled between the ball stud and the ball stud plate, the spring mechanism configured to facilitate pivotally moving the upper shelf with respect to the rack frame.

11. The adjustable shelf rack of claim 9, further comprising a latch assembly coupled to the upper shelf, the latch assembly comprising:

a mounting angle coupled to a front shelf member of the upper shelf; a housing coupled to the mounting angle, the housing defining a passage; and a pin slidably positioned with the passage, the pin movable within the passage between a retracted position and an extended position, in the extended position the pin extending into an opening defined in the first side member of the rack frame to lock the upper shelf in the closed position.

12. The adjustable shelf rack of claim 1, further comprising a base coupled to a bottom portion of the rack frame, the base comprising a guide for receiving a fork lift blade.

13. The adjustable shelf rack of claim 1, wherein the rack frame comprises a plurality of vertical posts and a projection formed on each post of the plurality of posts to facilitate stacking an additional rack frame on the rack frame.

* * * * *